US008573239B2

(12) United States Patent
Pritchard et al.

(10) Patent No.: US 8,573,239 B2
(45) Date of Patent: Nov. 5, 2013

(54) COLLAPSIBLE, PORTABLE STRUCTURE

(75) Inventors: Kerry Pritchard, Ellesmere Port (GB); Mark Thompson, Warrington (GB); Anthony Brereton, Dubai (AE)

(73) Assignee: Finecard International Limited, Widnes, Cheshire (GB)

( * ) Notice: Subject to any disclaimer, the term of this patent is extended or adjusted under 35 U.S.C. 154(b) by 0 days.

(21) Appl. No.: 13/325,188

(22) Filed: Dec. 14, 2011

(65) Prior Publication Data

US 2013/0037069 A1 Feb. 14, 2013

(30) Foreign Application Priority Data

Aug. 12, 2011 (GB) ..... 1113916.9

(51) Int. Cl.
*E04H 15/40* (2006.01)
*E04H 15/44* (2006.01)
*E04H 15/56* (2006.01)

(52) U.S. Cl.
USPC ..... 135/143; 135/126; 135/12; 135/137

(58) Field of Classification Search
USPC ..... 135/123, 124, 126, 127, 128, 137, 143; 160/352; 472/57, 75, 136; 446/82, 76, 446/476
See application file for complete search history.

(56) References Cited

U.S. PATENT DOCUMENTS

| | | | | |
|---|---|---|---|---|
| 2,504,926 | A * | 4/1950 | Gilbert | 472/77 |
| 3,397,710 | A * | 8/1968 | McElroy | 135/121 |
| 5,816,278 | A | 10/1998 | Kim | |
| 6,267,128 | B1 | 7/2001 | Zheng | |
| 6,698,441 | B1 | 3/2004 | Zheng | |
| 6,782,905 | B2 * | 8/2004 | Chu et al. | 135/143 |
| 7,357,692 | B2 * | 4/2008 | Klein et al. | 446/82 |
| 7,976,395 | B2 * | 7/2011 | Healey | 472/75 |
| 2001/0011550 | A1 * | 8/2001 | Zheng | 135/126 |
| 2004/0084075 | A1 * | 5/2004 | Zheng | 135/143 |
| 2005/0205123 | A1 | 9/2005 | Zheng | |
| 2007/0039640 | A1 | 2/2007 | Zheng | |
| 2010/0116306 | A1 * | 5/2010 | Zheng | 135/143 |

FOREIGN PATENT DOCUMENTS

| | | | |
|---|---|---|---|
| EP | 1054121 | A1 | 11/2000 |
| EP | 1462590 | A1 | 9/2004 |
| GB | 2426986 | A | 12/2006 |
| GB | 2426983 | B | 1/2010 |
| GB | 2426986 | B | 8/2010 |
| WO | 2008072235 | A2 | 6/2008 |

* cited by examiner

*Primary Examiner* — David Dunn
*Assistant Examiner* — Danielle Jackson

(57) ABSTRACT

A collapsible portable structure which may provide a play environment for children has side walling defining an upright corner region with a free side edge and a canopy which straddles the corner region. The canopy may provide a roof-like cover or at least a partial enclosure. The side walling is formed by at least one continuous loop of a flexible coilable rod supporting a flexible fabric panel. Thus there may be one curved or angular panel, or two adjoining panels or panel sections. The canopy is of flexile fabric and is attached to the fabric of the side walling at a location spaced inwardly from the free edge of the side walling. The canopy is supported separately from the side walling panels by at least one separate pole. A ground sheet may optionally be provided extending across the corner region between the lower edges of the side walling.

16 Claims, 4 Drawing Sheets

COLLAPSIBLE, PORTABLE STRUCTURE

RELATED APPLICATION

This application claims priority under 35 U.S.C. §119 to the United Kingdom Application No. 1113916.9 entitled "A Collapsible, Portable Structure" by the same inventors as the instant application filed on 12 Aug. 2011.

This invention concerns a lightweight portable structure of the kind which may be readily erected to form a temporary enclosure to serve, for example, as a play environment for children, yet may be readily collapsed for storage in compact form.

Many erectable/collapsible structures are known and/or are commercially available, referred to as "pop-up" tents or other "pop-up" structures, where support for fabric material of the structure is provided by a flexible coilable rod or more than one such rod. This rod or rods is/are readily foldable and twistable into a plurality of superimposed rings which assume a generally flat configuration so as to be packable into a bag for storage. Upon release, the rod(s) which is/are typically of steel or perhaps of plastics material, will resume its/their original shape so the structure pops up into being again.

Examples of such structures are described in U.S. Pat. No. 6,098,349 (Zheng) and all the prior art documents cited therein, and in the applicant's own earlier GB 2398233 and GB 2451651.

There is still a desire to increase the variety and applicability of pop-up structures making use of fabric supported by one or more coilable rods.

The present invention provides a collapsible portable structure having side walling comprising at least one continuous loop of a flexible coilable rod supporting a flexible fabric panel and an integrated canopy formed of flexible fabric material which is attached to the side walling and which is supported by at least one separate pole.

The side walling may be of curved or angular configuration or may comprise two or more adjoining walls or wall sections, the only requirement being that the side walling defines an upright corner region and has a free side edge.

The canopy preferably straddles the corner region.

The canopy is preferably attached to the side walling at a location spaced inwards from an upper edge of the side walling and/or at a location spaced inwards from the free side edge.

The canopy preferably provides a partial enclosure or a complete enclosure having an opening for access. However, it may just provide an awning-like cover or roof.

In some embodiments the canopy may be permanently attached to the side walling by stitching. In other embodiments the canopy may be attached in a releasable manner by means of sliding clasp fasteners (trade name Zip), hook and loop fasteners (trade name Velcro), clips, buttons or any other suitable attachment means.

In some embodiments the pole or poles which support the canopy is/are also positioned so as to provide support to decide walling.

Thus, in accordance with the present invention pop-up side walling is integrated with a canopy, which may provide an enclosure, which is partially supported by or formed by the side walling, and which is partially supported in more conventional manner by one or more poles, which may be separable/removable upon collapse of the structure.

The structure of the invention may, in a further development, also include an integrated mat or ground sheet, which may be attached to the side walling, to the canopy or to both.

In this way, a cost effective free standing structure, readily erected or collapsed, and compact for storage may be provided. It is envisaged in preferred embodiments to deliver an imaginative play environment for children, in which the side walling is decorated to provide a background set, the canopy provides a play house and a play mat/ground sheet applicable to the scene is optionally provided. However, in further embodiments, the structure may provide a combined windbreak and sunshade or tent particularly useful for the beach.

The invention will be described further, by way of example, with reference to the accompanying drawings, in which.

Figures 3, 3A, 3B:
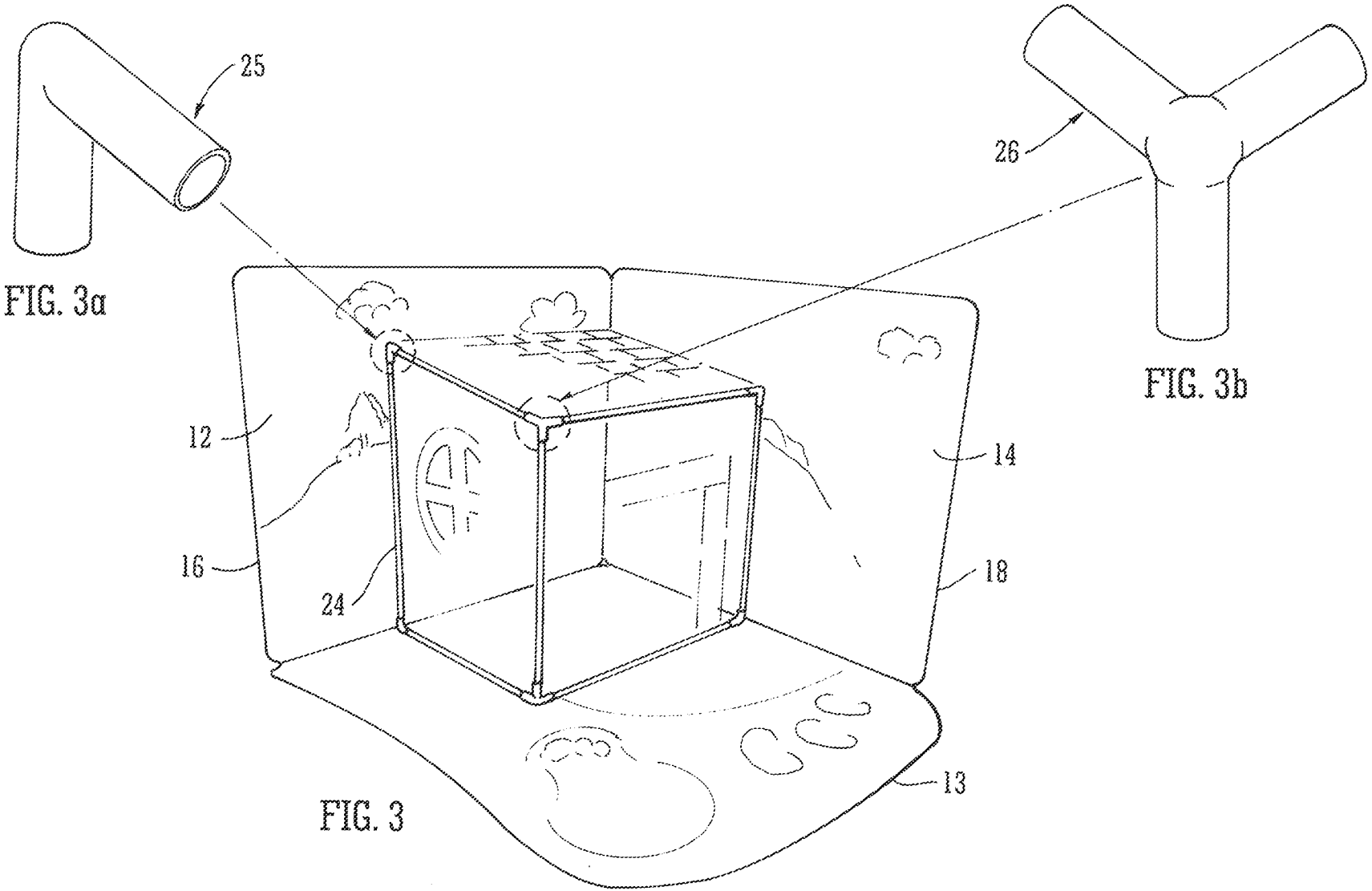
FIG. 3 is a further perspective view of the same embodiment showing the connected poles in supporting position, but omitting the canopy.
Figure 4:
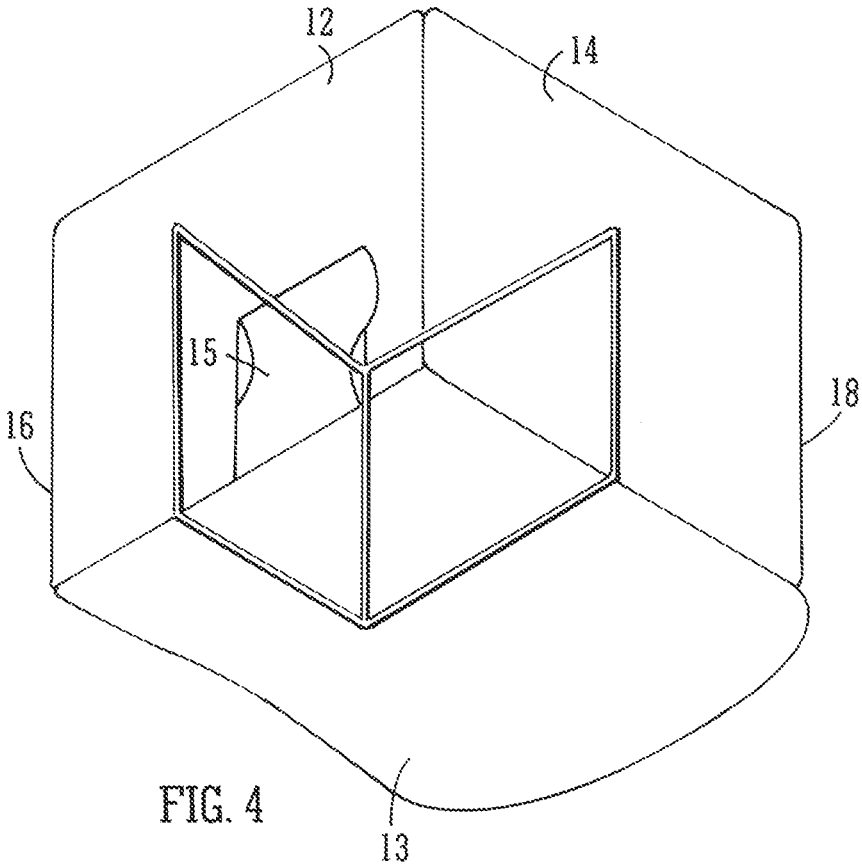
Figure 5:
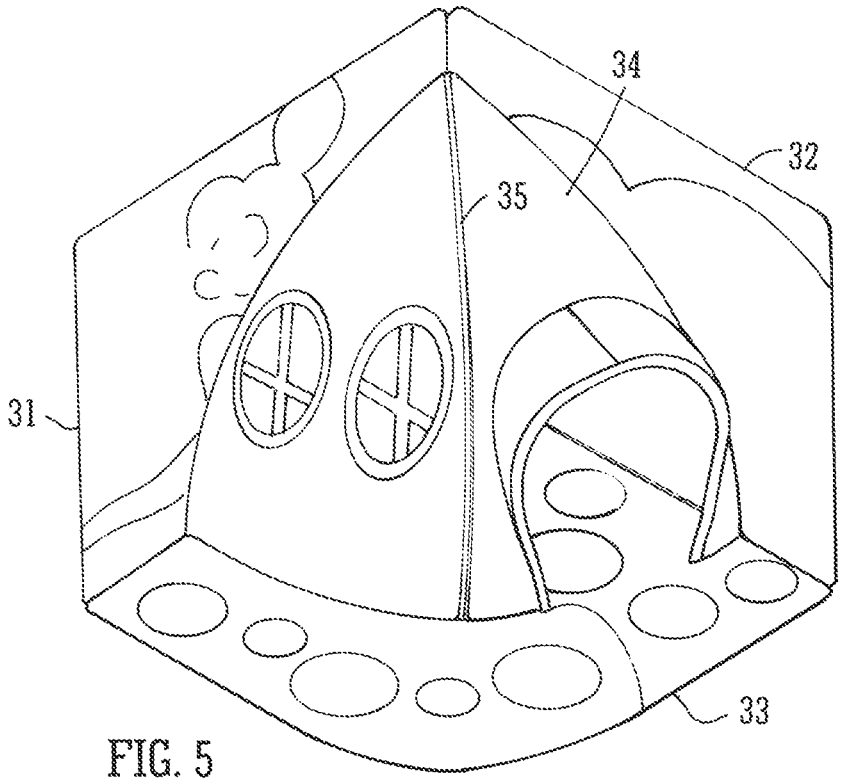
Figure 6:
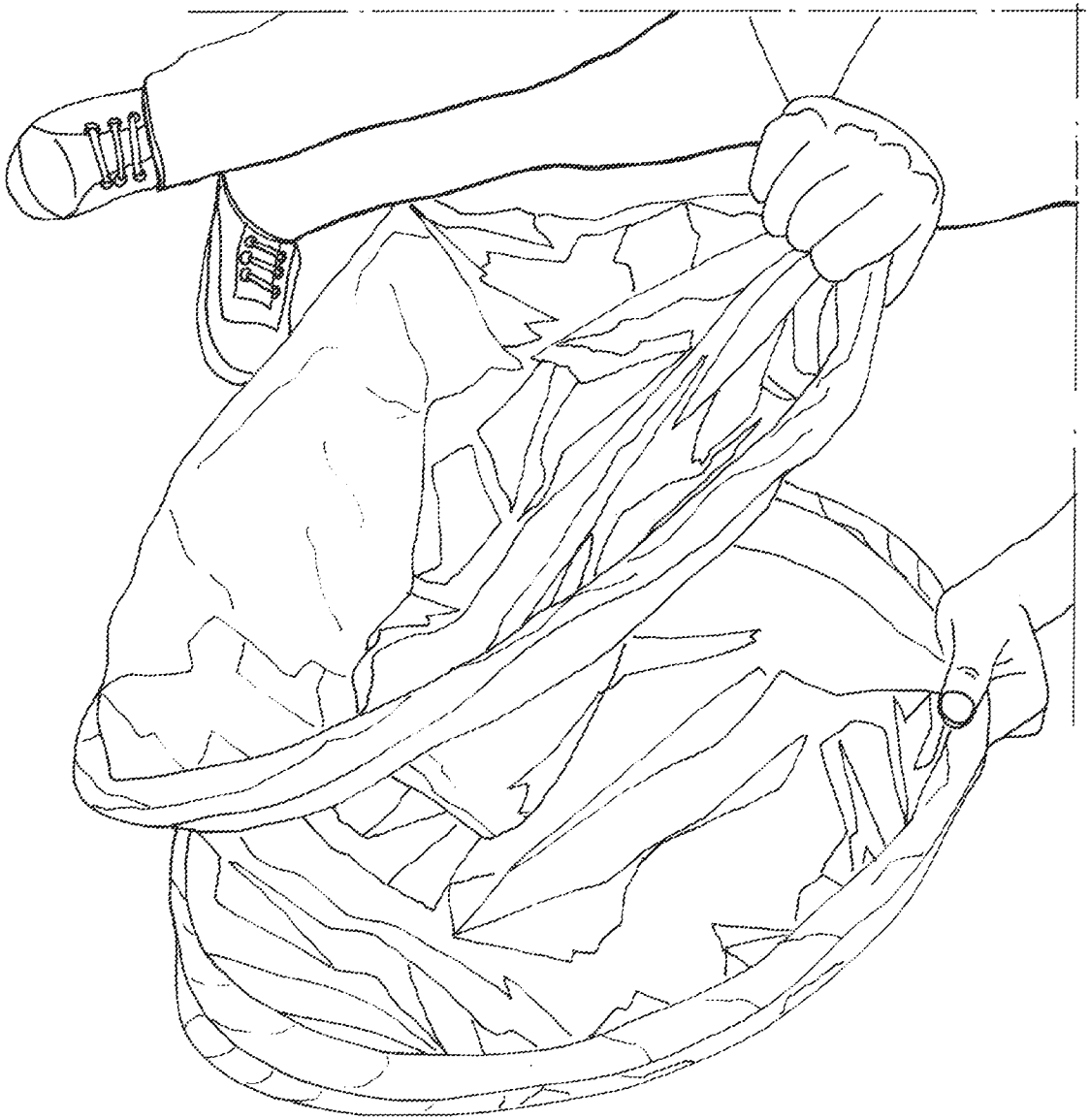

FIG. 3*a* is an enlarged detail of a first angled pole connector;

FIG. 3*b* is an enlarged detail of a second, three-way pole connector;

FIG. 4 is a further perspective view, similar to FIG. 3, but without any decoration/indicia on the fabric, and just as in FIG. 3, with the canopy omitted in order to show the supporting poles in position;

FIG. 5 is a perspective view of a second practical embodiment in accordance with the invention; and FIG. 6 is a perspective view showing how a structure in accordance with the invention, with support poles removed, is folded down by manual twisting of the coilable rods, or conversely how these are opened up in order to enable pop up erection of the structure.

Referring to FIGS. 1 to 4, this exemplary embodiment of a collapsible structure in accordance with the invention comprises two printed fabric panels 12, 14 providing respective side walls which are arranged substantially at right angles to each other, thus providing an upright corner region with each panel having a respective free side edge. The panels may be of textile fabric, woven or non-woven, or any other suitable flexible sheet material. Each of these panels 12, 14, is supported by a respective peripheral frame 16, 18, which consists of a closed loop of a flexible, coilable rod, e.g. of steel or plastics material. These frames 16, 18 may extend in sleeves or tunnels around the periphery of the fabric, or be otherwise attached. In this particular embodiment, the erected frames 16, 18 are substantially rectangular, with curving corners. At the intersection between the two side walls, there are adjoining side members of the respective frames which may be held together in any suitable manner, as by extension/continuation of the fabric panels 12, 14 or by additional straps or connectors. The lower edges of the side walls, namely the lower edge frame members, or lower edges of the fabric panels 12, 14 are in this embodiment joined by a printed fabric groundsheet 13.

Attached to the fabric panels 12, 14, spaced apart from the upper and free (outer) side edges, is a fabric canopy 20. In this example, the canopy 20 has wall and roof sections and these are stitched to the fabric panels 12, 14 and to the groundsheet 13 as depicted diagrammatically at 19 in FIG. 2.

Figure 1:
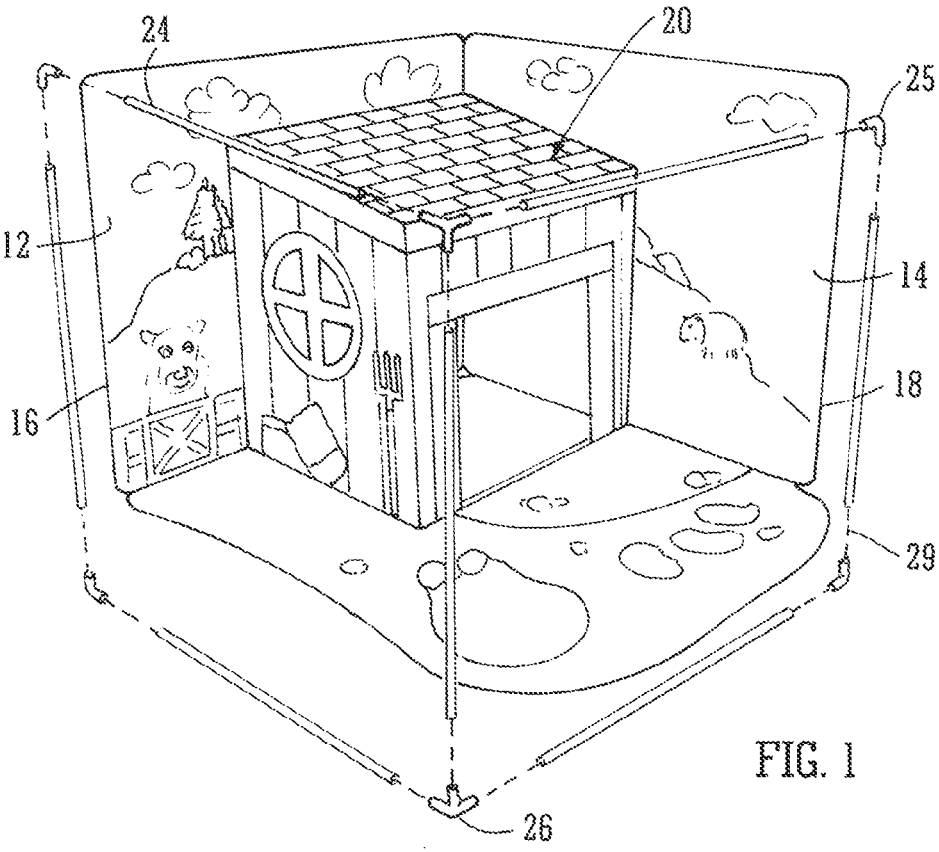
FIG. 1 is a perspective view of a first practical embodiment in accordance with the invention overlaid by depiction of the support poles in expanded form showing their relative positions, these being in use connected together as shown and located inside the illustrated corner canopy.
Figure 2:
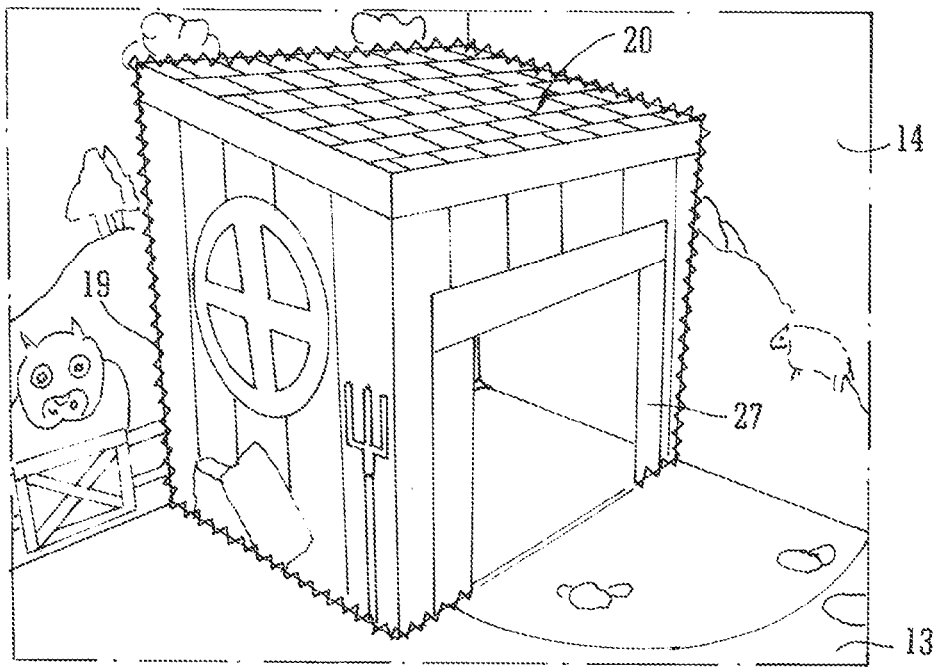
FIG. 2 is an enlarged partial view of the same embodiment with diagrammatic indication of where the canopy is stitched to the side walls and groundsheet.

The structure described so far can be collapsed by manual twisting of the frames 16,18 of the fabric panels so that these are folded down into superimposed rings, as indicated in FIG. 6. In this form, they can be stored in a bag, and thus restrained against springing apart. However, in order to re-erect this structure, it is only necessary to remove it from the bag and slightly untwist, in which case the frames 16,18 pop up to resume their initial configuration and as they are constrained by the adjoining fabric of the panels 12, 14 and the groundsheet 13, the same overall form as shown is resumed. The canopy 20, however, is unsupported. A separate arrangement of conventional supporting poles 24, as shown in FIGS. 1, 3 and 4 is provided. These poles 24 will, in use, be taken inside the canopy 20 and joined together there by means of the corner connectors 25, 26 which are shown in FIGS. 3*a* and 3*b*. Obviously, the poles 24 are chosen to be of an appropriate size corresponding to the canopy corners and roof section edges where support is required, and the connectors, similarly, are of appropriate configuration to connect these together, as shown.

As depicted diagrammatically in FIG. 1, the poles and the connectors could be held together by means of an internal elastic cable 29, in known manner, so that their relative positioning is maintained and they then have only to be connected manually in the require configuration by standard push fit connection. Alternatively, the poles and their connectors could just be provided as separate items.

As indicated, particularly in FIG. 4, a further possibility is a flap 15 provided in one of the fabric panels 12 to provide a back entrance to the enclosure formed by the canopy 20, which already has a front entrance 27 provided in one of the canopy walls.

The illustrated version has the fabric panels 12, 14 and the groundsheet 13 printed to simulate a farmyard scene and the canopy 20 configured and printed as a barn. Obviously, in other embodiments different scenes and environment may be depicted on the printed panels and as regards the canopy. Different arrangements of entrance and other apertures may be provided in the canopy and the fabric panels. Also, any or all of these could be formed totally or partially of mesh form. The form of the canopy and the configuration of poles for supporting same may also vary in other embodiments.

FIG. 5 illustrates such an alternative. The side walls 31, 32 and integral groundsheet 33 are essentially as already described, just printed to show a different scene, but the canopy 34 is of curving form and may be supported by a single curving or flexible pole, which could be attached internally by way of straps at the seam 35 connecting the two triangular panels of the canopy 34 and/or restrained by having its ends locate in pockets formed at the apex and base of the seam 35, inside the canopy. However, a larger number of supporting poles could be provided to be connected inside this shape of canopy, for example following the edge adjoining each side panel, as well as between the canopy panels and around the base of the canopy where it is attached to the groundsheet.

Many other variations in overall configuration, style of canopy, number and arrangement of supporting posts and decoration of panels and canopy are possible in other embodiments within the scope of the invention. Further, it is possible that instead of two side walls, a single curving or angular sidewall structure may be provided, supported by one or more flexible, coilable rod or rods. In other embodiments, more than two side walls of this type may be provided. Also, where two or more sidewalls are provided, it is not necessary to have a separate flexible, coilable rod to support each separately, or to support each respective fabric panel. A single flexible, coilable rod may be configured to have more than one loop, each loop then supporting a respective fabric panel or panel section, but the fabric itself may also be continuous or connected between the respective panels.

What is claimed is:

1. A collapsible portable structure having side walling comprising at least one continuous loop of a flexible coilable rod supporting a flexible fabric panel and an integrated canopy formed by a flexible fabric material which is permanently attached to the side walling and which is supported by at least one separate pole, wherein the side walling is configured to define an upright corner region and to have a free side edge, wherein the integrated canopy comprises at least a (partial enclosure comprising at least one wall section and at least one roof section.

2. A structure as claimed in claim 1, wherein the side walling is configured to be curved or angular to define the upright corner region and to have the free side edge.

3. A structure as claimed in claim 2, wherein the canopy straddles the upright corner region.

4. A structure as claimed in claim 2, wherein the canopy is attached to the side walling at a location spaced inwards from the free side edge.

5. A structure as claimed in claim 2, wherein the continuous loop of a flexible coilable rod provides a frame at the periphery of the fabric panel.

6. A structure as claimed in claim 1, wherein the side walling is configured to comprise two or more adjoining walls or wall sections to define the upright corner region and to have the free side edge.

7. A structure as claimed in claim 1, wherein the canopy is attached to the side walling at a location spaced inwards from an upper edge of the side walling.

8. A structure as claimed in claim 1, wherein the side walling is formed by two continuous loops of the coilable rod, each loop supporting a respective flexible fabric panel.

9. A structure as claimed in claim 1, wherein the side walling comprises two distinct side walls, wherein the first side wall is formed by a first continuous loop of a coilable flexible rod and the second side wall is formed by a second continuous loop of a coilable flexible rod.

10. A structure as claimed in claim 9, wherein the side walls are arranged to extend substantially perpendicular to each other.

11. A structure as claimed in claim 1, wherein the canopy is stitched to the side walling.

12. A structure as claimed in claim 1, further comprising an integrated mat or ground sheet attached to the side walling.

13. A structure as claimed in claim 1, wherein the at least one separate pole comprises a plurality of poles to support the canopy, the poles being attached to each other by means of connectors.

14. A structure as claimed in claim 1, wherein the side walling is collapsible by twisting each of the flexible coilable rods.

15. A structure as claimed in claim 1, wherein the at least one separate pole comprises a plurality of poles that do not form part of a closed loop of a flexible coilable rod and that are attached to each other by means of connectors.

16. A structure as claimed in claim 1, wherein the integrated canopy comprises at least a complete enclosure having at least one opening access in the at least one wall section.

* * * * *